US005467613A

United States Patent [19]

Brasz

[11] Patent Number: 5,467,613

[45] Date of Patent: Nov. 21, 1995

[54] TWO PHASE FLOW TURBINE

[75] Inventor: Joost J. Brasz, Fayetteville, N.Y.

[73] Assignee: Carrier Corporation, Syracuse, N.Y.

[21] Appl. No.: 222,966

[22] Filed: Apr. 5, 1994

[51] Int. Cl.[6] ..... F25B 1/00; F01K 25/00

[52] U.S. Cl. ..... 62/402; 62/116; 60/671; 417/405

[58] Field of Search ..... 62/116, 402; 60/651, 60/671; 417/375, 405

[56] References Cited

U.S. PATENT DOCUMENTS

| | | | |
|---|---|---|---|
| 2,615,615 | 10/1952 | Young | 417/405 X |
| 2,737,031 | 3/1956 | Wulle | 62/87 |
| 3,932,159 | 1/1976 | Goldsberry | 62/510 |
| 3,934,424 | 1/1976 | Goldsberry | 62/87 |
| 3,938,336 | 2/1976 | Eskeli | 60/682 |
| 4,077,748 | 3/1978 | Pötz | 417/405 X |
| 4,086,772 | 5/1978 | Williams | 60/651 |
| 4,106,294 | 8/1978 | Czaja | 60/649 |
| 4,235,079 | 11/1980 | Masser | 62/87 |
| 4,304,104 | 12/1981 | Grose | 62/324.2 |
| 4,336,693 | 6/1982 | Hays et al. | 62/116 |
| 4,361,015 | 11/1982 | Apte | 62/238.4 |
| 4,438,638 | 3/1984 | Hays et al. | 62/500 |
| 4,442,682 | 4/1984 | Sakata et al. | 62/401 |
| 4,463,567 | 8/1984 | Amend et al. | 60/671 |
| 4,484,457 | 11/1984 | Mugele | 60/500 |
| 4,503,683 | 3/1985 | Wieland et al. | 62/86 |
| 4,507,939 | 4/1985 | Wieland | 62/402 |
| 4,509,341 | 4/1985 | Zimmern | 62/512 |
| 4,563,201 | 1/1986 | Brundige, Jr. | 62/11 |
| 4,576,006 | 3/1986 | Yamaoka | 60/641.5 |
| 4,658,592 | 4/1987 | Wagner et al. | 60/689 |
| 4,876,855 | 10/1989 | Yogev et al. | 60/651 |
| 4,905,481 | 3/1990 | Scaringe et al. | 62/500 |
| 5,040,370 | 8/1991 | Rathbone | 60/648 |
| 5,136,854 | 8/1992 | Abdelmalek | 62/116 |
| 5,214,932 | 6/1993 | Abdelmalek | 62/238.4 |
| 5,216,899 | 6/1993 | Fabris | 62/324.6 |
| 5,249,934 | 10/1993 | Merritt et al. | 417/406 |

FOREIGN PATENT DOCUMENTS

| | | | |
|---|---|---|---|
| 2040486 | 2/1972 | Germany | 417/409 |
| 0285692 | 11/1989 | Japan | 417/405 |

*Primary Examiner*—William E. Wayner

[57] ABSTRACT

A single-fluid two-phase turbine expander is employed in a compression-expansion refrigeration system. The turbine expander has its rotor mechanically coupled to the drive train of the associated refrigeration compressor, which can be a high-speed centrifugal compressor or a geared screw compressor. The turbine is a straight-forward design, with a rotor disk having peripheral vanes, and a nozzle block that houses the disk and contains a group of nozzles that are directed at the vanes. The nozzles each have an inlet orifice plate and a converging/diverging internal geometry that permits supersonic discharge. The vanes are shaped for impulse reaction and have a sharp exit bend to prevent further flashing of the two-phase mixture in the rotor.

12 Claims, 5 Drawing Sheets

TWO PHASE FLOW TURBINE

BACKGROUND OF THE INVENTION

This invention relates to compression/expansion refrigeration, and is particularly concerned with chiller, air conditioning, heat pump, or refrigeration systems in which a turbo-expander is employed to expand the condensed refrigerant to a reduced pressure and to permit recover), of a portion of the energy of the compressed fluid.

Single-fluid two-phase flow systems typically incorporate an expansion valve, float valve, or other mechanical pressure regulator between the condenser heat exchanger and the evaporator heat exchanger to expand the fluid, i.e., to throttle the flow of refrigerant fluid from a high pressure to a low pressure.

The use of a turbine or turboexpander in a refrigeration cycle has been previously proposed with the aim of improving the refrigeration efficiency. Some type of bi-phase flow turbine is required to replace the isenthalpic expansion process of a throttling expansion valve with an isentropic expansion process. That is, the turbine absorbs some of the energy of the expanding refrigerant and converts it to rotational energy. At the same time, the liquid fraction of the refrigerant that enters the evaporator is increased. Ideally, the energy of the expanding refrigerant can be recovered and used to reduce the amount of motor energy needed to drive the system compressor.

U.S. Pat. No. 4,336,693 describes a refrigeration system that employs a reaction turbine as an expander stage. In this approach, a centrifugal reaction turbine performs the expansion function, and operates to separate vapor from the liquid before extracting power. This produces increased efficiency over a conventional turboexpander. In this prior patent, the energy produced by the turbine can be used to drive a load, such as a generator.

However, turbines placed in this role have not been particularly efficient for a number of reasons. In most refrigeration processes, where refrigerant is brought from a saturated liquid phase to a low-quality two-phase liquid/vapor state, the expansion process produces a relatively small amount of work, compared to the work input required for the compressor. Moreover, turbines that have been conventionally employed are not only smaller in capacity than the compressor, but also operate under conditions of low efficiency due to the two-phase flow and speed of the expanding fluid. For optimal efficiency, the two-phase flow turbines also require a completely different speed from the compressor. Consequently, the conventional engineering practice is not to employ a turbine expander because the small amount of savings in energy recovery and efficiency gains are far outweighed by the reduced initial and maintenance costs of a throttling valve.

A single fluid, two-phase flow turbine expander can be made practical and efficient only if critical relationships of the turbine to the rest of the refrigeration system are observed. Direct coupling of the turbine rotor shaft to the drive of the compressor is possible if the turbine rotor has a design speed that permits it to serve as a high-efficiency expander, the turbine matches the properties of the refrigerant, such as vapor density and two-phase flow acoustic velocity, and the capacity of the refrigeration system (i.e., refrigerator, chiller or air conditioner) satisfies optimal mass flow conditions of the turbine expander. However, no previous system has observed these criteria, and so the desired efficiency increases have not been achieved.

For medium- to high-pressure refrigerants such as R134A and R22, two-phase flow turboexpanders can be employed, of the type described e.g., in Ritzi et al., U.S. Pat. No. 4,298,311, Hays et al. U.S. Pat. No. 4,336,693 and Hays et al. U.S. Pat. No. 4,438,638. These patents relate to turbines driven by a two-phase working fluid where most of the fluid mass (e.g. 90%) is liquid, and one or more nozzles directs the condensed refrigerant at a rotor so that the vapor and liquid mixture impacts the rotor. These turbines are designed as reaction turbines, so that kinetic energy of the expanding vapor is transformed into kinetic shaft output energy rather than into heat. This, in theory, maximizes the liquid fraction of the total mass of the working fluid after expansion.

However, in any given application, the size of the turbine that provides optimal expansion will not provide suitable output shaft power. No effort has been made to match the turbine's expansion capacity for a given mass flow with the required shaft speed to permit direct coupling to the compressor drive.

OBJECTS AND SUMMARY OF THE INVENTION

It is an object of this invention to provide a refrigeration system with a two-phase flow turbine expander that approaches isentropic expansion of the condensed fluid, permits recovery of a substantial fraction of the energy used for compression, and which avoids the drawbacks of the prior art.

It is a further object of this invention to provide a turbine expander which can operate with a single moving pan.

It is another object of this invention to couple the rotor shaft of the turbine expander directly to the motor shaft or an existing drive train shaft of the compressor of a refrigeration system, thereby minimizing windage, bearing losses, mechanical losses and electrical losses, as well as minimizing systems cost and complexity.

According to an aspect of this invention, a single-fluid two-phase-flow turbine expander with a slightly sub-cooled to a low-vapor quality inlet condition is directly i.e., mechanically coupled to the drive train of the associated refrigeration compressor both to expand the condensed refrigerant isentropically and also to recover a significant amount of the compression energy of the refrigerant and apply that energy to rotating the compressor.

For a refrigeration system of a capacity of 100 to 1000 tons, employing a high-pressure refrigerant such as R22or R134A, and a centrifugal or screw compressor driven by a two-pole induction motor (3000 to 3600 rpm), the turbine efficiency is estimated at about 60%. Depending on operating conditions, the turbine reduces the motor load by 6–15% compared to the system with a throttling expansion valve. A similar system employing a low-pressure refrigerant, such as R123 or R245ca, would permit a much smaller recovery due to the need for an increased turbine rotor diameter and lower rotor shaft speed. Ideally, a recovery of about 2–6% is possible.

Efficient energy recovery can also be achieved if the turbine expander is employed in a refrigeration system below 100 ton capacity having a screw compressor or other type of rotary compressor as long as the critical relationship between speed and capacity can be observed. For example, in systems using high pressure refrigerants, the turbine expander can be coupled directly to the high-speed shaft of a 40-ton geared screw compressor, running at 12,000 rpm or an inverter-driven 5-ton scroll compressor running at 40,000 rpm.

The turbine is of a straightforward simple design, having a rotor disc with peripheral vanes, and a nozzle block that houses the disc and contains a group of nozzles that are directed at the vanes. The nozzles each have an inlet orifice plate to facilitate breakdown of vapor pockets which flash off from the liquid. The nozzles have an internal geometry that converges to a waist and then diverges to an outlet. This design achieves supersonic discharge velocities, and creates a through-flow pressure gradient that favors a breakdown of liquid droplets. The rotor vanes are curved to creates a pure impulse design to prevent further flashing of the two-phase mixture at the rotor. The rotor is an axial flow design, with a circumferential shroud over the vanes to prevent liquid drag and to avoid circulation and re-entry of the liquid.

The above and many other objects, features, and advantages of this invention will become apparent from the ensuring description of a preferred embodiment, to be read in conjunction with the accompanying Drawing.

DETAILED DESCRIPTION OF THE PREFERRED EMBODIMENT

Figure 1:
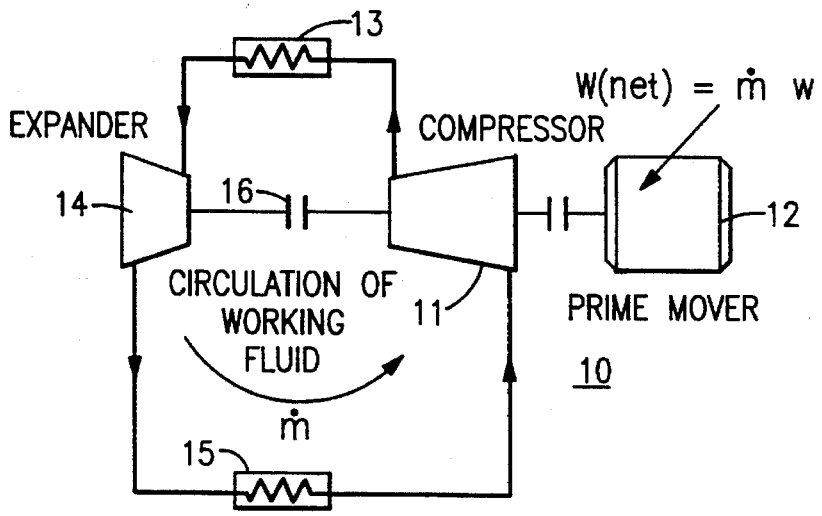
FIG. 1 is a schematic view of a single-fluid compression/expansion refrigeration system of the type that incorporates a turboexpander.

With reference to the Drawing, and initially to FIG. 1, a refrigeration system 10 for a heat pump, refrigerator, chiller or air conditioner is shown schematically to comprise a compressor 11 that is driven by an electric motor 12 or other prime mover. The compressor 11 compresses a working fluid that exists in the system in its liquid and vapor phases or states. The compressor discharges the compressed vapor, at high pressure and high temperature, into a condenser 13 which exhausts heat from the working fluid and condenses the high pressure vapor into the high pressure liquid. The liquid flows from the condenser 13 into a turbine expander 14. The high-pressure liquid flows into a high pressure port and drives a turbine rotor with the kinetic energy of the expanding working fluid. In other words, a portion of the energy imparted to the working fluid by the compressor 11 is recovered in the expander 14. From here, the working fluid flows at low pressure, into an evaporator 15, in which the working fluid absorbs heat from an environmental zone, and the absorbed heat converts the working fluid from the liquid to the vapor state. The vapor from the evaporator 15 reenters the compressor 11 on an intake side. In this schematic view, a linkage 16 from the turbine expander 14 to the compressor 11 mechanically joins the shafts of these two elements, so that the turbine expander 14 actually assists the motor 12 in driving the compressor 11. The turbine expander relieves some of the compressor load on the motor 12, so that the refrigeration cycle is operated more efficiently than is possible with a different type of expander, such as a throttling expansion valve.

Figure 2A:
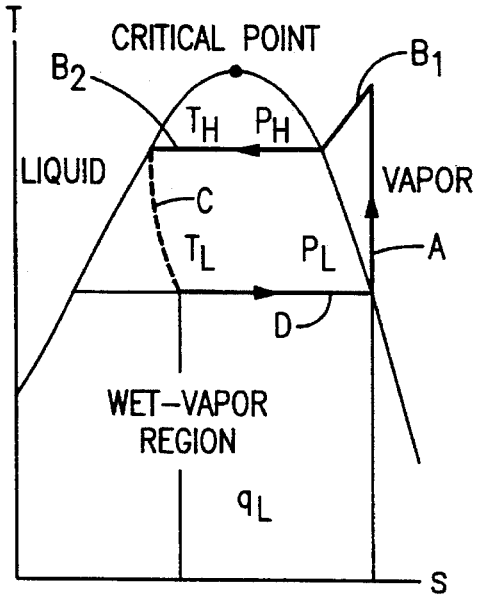
FIGS. 2A and 2B are refrigerant compression/expansion cycle charts for systems that employ a throttling expansion valve and a turbine expander, respectively.

FIG. 2A is a vapor compression curve for a conventional refrigeration system having a throttling expander valve. In this chart temperature T appears as the ordinate while entropy S appears along the abscissa. The compression/expansion cycle shows the isentropic compression of vapor as a vertical line A, and then superheat cooling of the vapor occurs at line B1, followed by biphase isothermal condensation at line B2. When the working fluid passes through the throttling valve expander, the working fluid undergoes isenthalpic expansion, which descends somewhat to the right, as indicated at curve line C. Isothermal evaporation of the liquid in the evaporator is shown as the horizontal straight line D. It is apparent from this chart that with isenthalpic expansion the quality of the expanded refrigerant working fluid is increased somewhat because some of the compression energy of the condensed working fluid is consumed in transforming the liquid into vapor at the low-pressure side of the system. For efficient operation, the quality of the working fluid, that is, the vapor fraction of the expanded refrigerant, should be as small as possible.

Figure 2B:
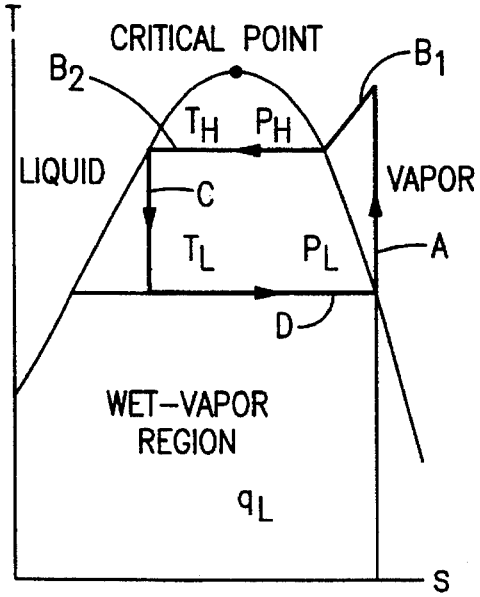

FIG. 2B shows a chart similar to that of FIG. 2A, but for a system which achieves isentropic expansion of the working fluid through the turbine expander. The isentropic expansion is shown as a vertical line C'. Here, at least some of the energy of compression is recovered from the working fluid passing through the expander, and is convened to mechanical energy and returned to the compressor. This means a higher fraction of the refrigerant enters the evaporator as liquid, and a greater amount of cooling can be accomplished with the same mass flow of refrigerant. With the efficient use of a turbine expander, higher cooling efficiency is possible. With high pressure refrigerants, such as R12, R22, and R134A, the throttling loss through a standard expansion valve can be as high as 20%, and for a low pressure refrigerant such as R123 or R245ca, the throttling loss can be 12%. However, if a throttling type expander can be replaced with a turbine expander having an efficiency of 50%, a significant amount of this throttling loss can be recovered. Thus, a turbine expander that is directly (i.e., mechanically) coupled to the shaft of the compressor can achieve a measurable improvement in refrigeration efficiency. To date, the use of a turbine expander to improve the efficiency of a refrigeration cycle has been an unrealized ideal. Practicalities in matching the expander turbine to the cooling system have not been achieved. For example, for efficient operation the expander turbine wheel size and rotation speed must match the mass flow and pressure drop requirements of the system. Also, for economic reasons, this turbine speed should correspond to an available shaft speed of the drive train of the compressor. For efficient operation the turbine must provide a sufficient amount of power to the compressor so that efficiency gains justify the increased equipment costs of the turbine. Finally, the turbine design must be simple and reliable to minimize both initial cost and maintenance costs.

Figure 3:
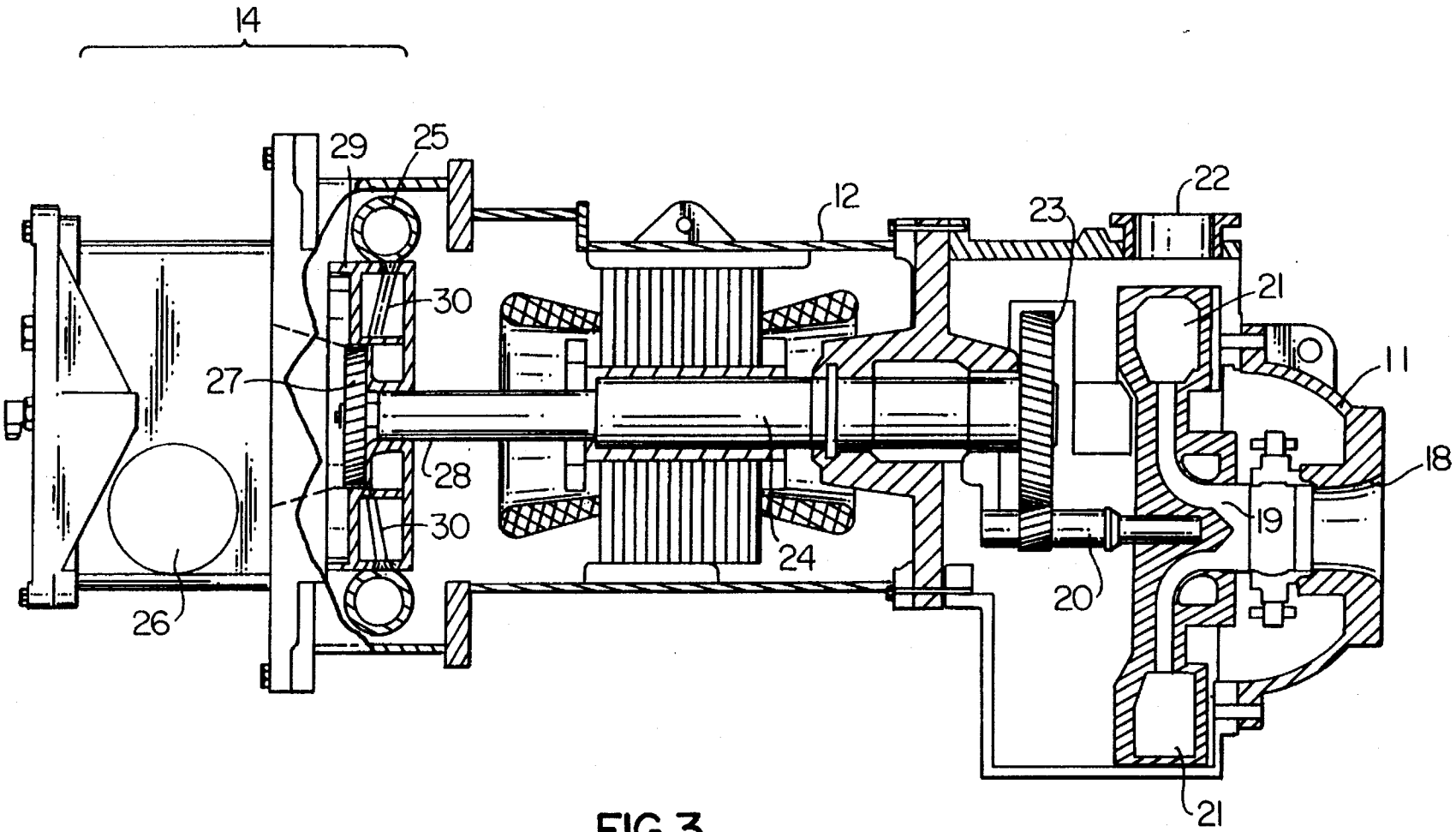
FIG. 3 is a cross section of a combination centrifugal compressor and turbine expander according to one embodiment of the present invention.

FIG. 3 is a cross-sectional view of a compressor and expander assembly according to one practical embodiment of this invention. Here, a three-phase two pole motor 12 is attached to the housing of a high-speed centrifugal compressor 11. The compressor has an inlet 18 into which the vapor is fed from the evaporator, and an impeller or rotor 19 which is driven by rotor shaft at high speed, typically at about 15,000 RPM. The working fluid is driven centrifugally and enters into a diffusion chamber 21, where kinetic energy from the impeller is transformed into pressure. Compressed gas then proceeds to an outlet 22 which is coupled to a condenser heat exchanger (not shown). The impeller shaft 20 is driven through a step-up gear box 23 which is in turn driven by a motor shaft 24, of the motor 12. In this embodiment the motor shaft 24 turns at a design speed of about 3600 rpm.

Attached to the other end of the motor 12 is the turbine expander 14. Here an inlet plenum 25 receives the condensed, liquid working fluid at high pressure, and an outlet plenum 26 discharges the working fluid at low pressure to the evaporator heat exchanger (not shown).

Figure 5:
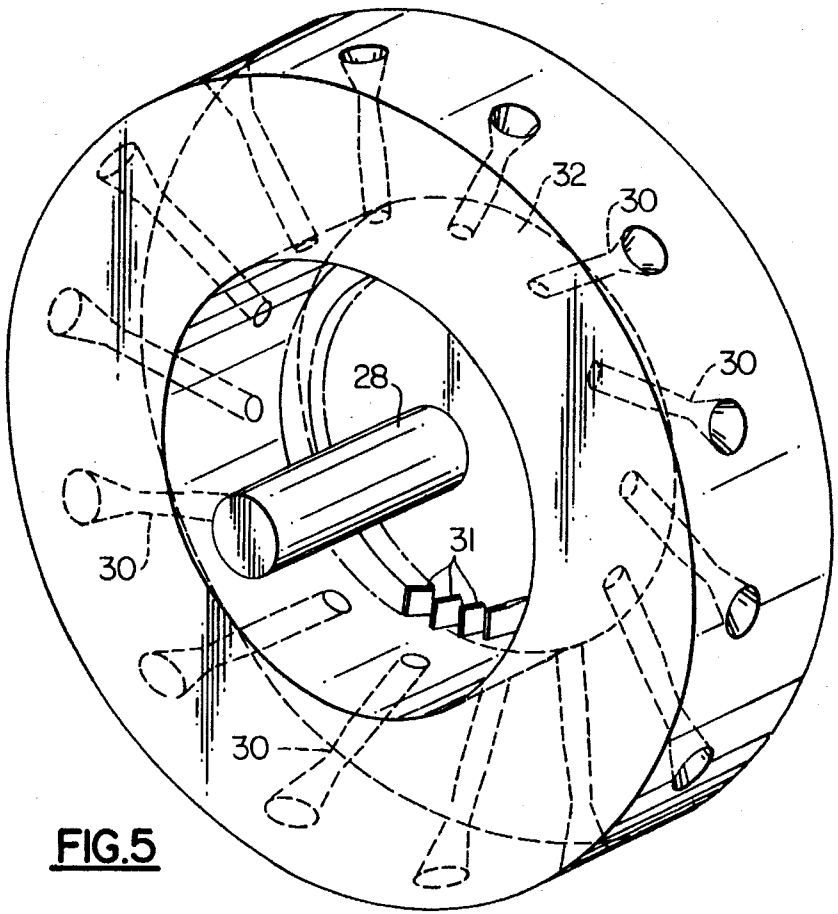
FIG. 5 is a similar perspective, but showing the nozzle block in ghost.
Figure 4:
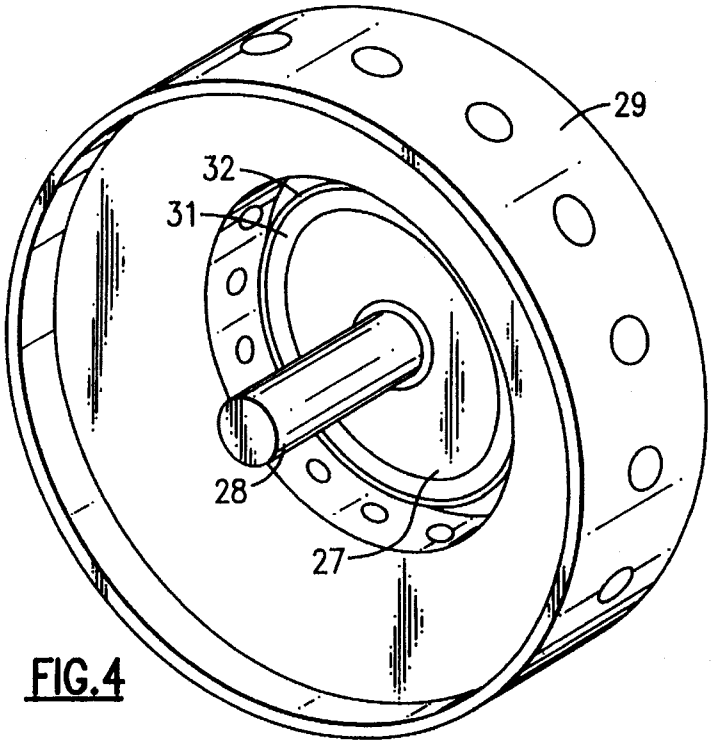
FIG. 4 is a perspective view of the rotor and nozzle block of the turbine expander of this embodiment.
Figure 5A:
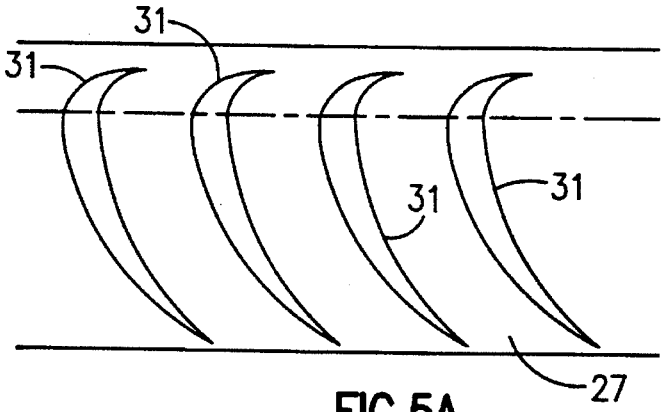
FIG. 5A is a schematic view of the rotor, showing geometry of the vane profile.

Within the turbine expander 14, a rotor disk 27 is mounted on a shaft 28 that is married to the motor shaft 24. A nozzle block 29 circumferentially surrounds the disk 27 and contains a plurality of nozzles 30. These nozzles 30 have their proximal ends in communication with the inlet plenum 25, and their distal ends directed at the rim of the rotor disk 27. FIGS. 4 and 5 show the general arrangement of the rotor 27 and the nozzle block 29. The rotor disk 27 has peripheral blades 31 arranged for axial flow and designed for impact reaction with concave buckets, and a sharp bend on the exit side (i.e., at the top in FIG. 5A) profile of the blades or vanes 31 is shown in FIG. 5A. A rotor shroud 32, carried on the radially outward edges of the blades 31, prevents liquid drag. The rotor 27 is of a pure impulse type design to prevent flashing of the two-phase flow mixture in the rotor. Also, the axial flow design avoids the negative effects of liquid centrifuging out, which can occur in a radial inflow design, or the negative effects of liquid reentering the rotor over the top of the blades. The sharp bend at the blade exit reduces liquid friction at the blade pressure surface.

Figure 6:
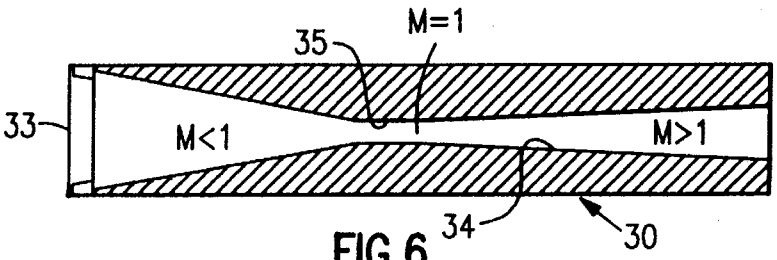
FIG. 6 is a longitudinal cross section of one of the nozzles of this embodiment.

Design of the nozzles 30 is shown in cross section in FIG. 6. An inlet multiple-hole orifice plate 33 facilitates breakdown of the vapor pockets as they flash off from the liquid, by providing a large number of small passages. The nozzle 30 has an internal profile 34 of converging/diverging design; that is, the profile converges to a waist 35, and then diverges to an exit end. In one typical design, the nozzle achieves an output velocity of 200 feet per second, and an output pressure of 52 psia, with a vapor fraction of 0.15. In this embodiment, the rotor disk 27 has a diameter of 7.5" so that at an optimum rotor speed of 3600 rpm, the rotor has a linear vane speed of 100 feet per second. That is the vane speed is one-half the velocity of the two-phase flow mixture. This means that impact of the bi-phase fluid from the nozzles onto the vanes of the rotor provides a minimal flash and that a maximal amount of the kinetic energy of the liquid-vapor mixture is transferred to the rotor disk 27. In a 500-ton water cooled chiller arrangement, employing a high pressure refrigerant, (typically R134A) the turbine expander has an inlet volumetric flow rate of 20 CFM, and an outlet volumetric flow rate of about 265 CFM. Isentropic discharge velocity is 200 feet per second with a nozzle discharge cross sectional area of about 3.50 square inches. The rotor has a diameter of 7.50 inches, as aforementioned. Turning at a rotor speed of 3600 RPM, the turbine has an overall efficiency of 60%, and achieves a turbine output power of about 17.5 horsepower. For a similar 500-ton system employing a low-pressure refrigerant, such as R245CA, the turbine expander would have an inlet volumetric flow rate of 17 CFM and an outlet volumetric flow rate of 1206 CFM. The isentropic nozzle discharge velocity is 161 feet per second with a nozzle discharge cross sectional area of 21.4 square inches. In this case, for the rotor speed to be optimum, the rotor diameter would need to be 25 inches, necessitating a lower optimum rotor speed of 1,200 RPM. This can be achieved by connecting the turbine rotor shaft through a 3:1 gearing arrangement to the motor shaft 24. For the low pressure system, the turbine power, i.e., the amount of power recovered by the turbine, is much lower about 8.3 horsepower, and the estimated overall turbine efficiency is about 45%.

Returning to FIG. 5, in this embodiment there are fourteen of these nozzles 30, distributed radially around the block 29. However, the number of nozzles and their relative sizes can vary according to factors such as mass flow, pressure difference and the like.

Figure 7:
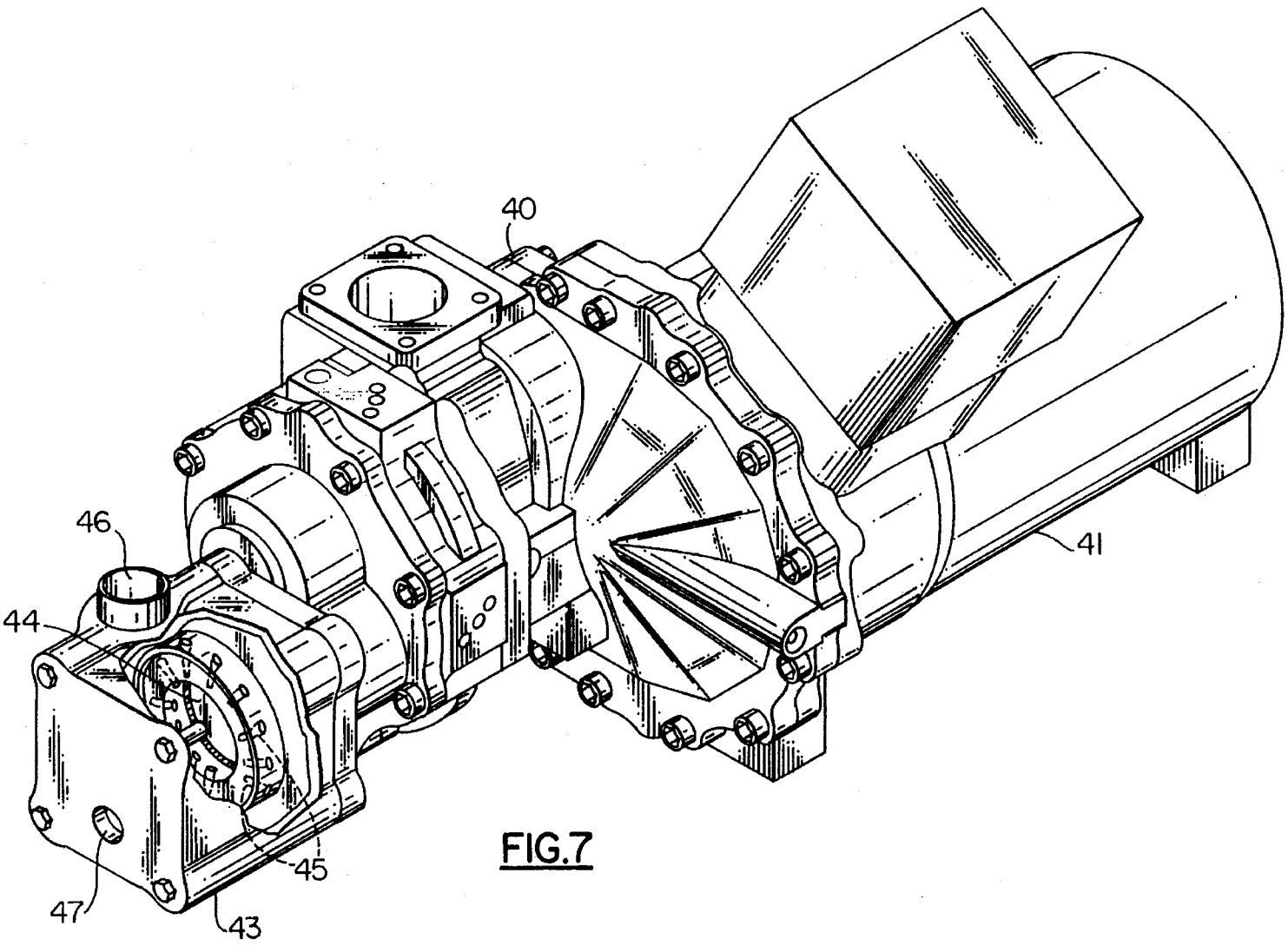
FIG. 7 is a view of another practical embodiment, showing a high speed screw compressor, with an associated turbine expander illustrated in ghost.

FIG. 7 shows an alternative embodiment, to wit, a high speed screw type compressor for a smaller system, i.e., 50-ton capacity. In this case, the high speed screw compressor 40 is driven by an induction motor 41 and a turbine expander 43 is coupled to the shaft of high-speed male screw (not shown) of the compressor. In the turbine expander, shown here in ghost line, the rotor 44 is driven in rotation by jets that emanate from nozzles 45. An inlet plenum 46 receives the high-pressure liquid working fluid and an outlet plenum 47 discharges the low pressure working fluid as a liquid/vapor mix. In addition to the compressor and the geared-screw compressor of the embodiments known here, the two-phase flow turbine expander can be directly coupled to the drive shaft for any of the large variety of compressors. The turbine expander can be directly coupled, i.e. shaft to shaft or through gearing arrangement, to the drive train of the refrigeration, air conditioning, or chiller compressor.

Figure 8:
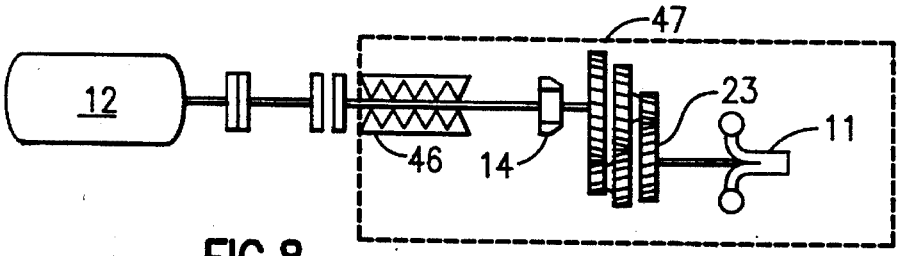
FIGS. 8, 9, and 10 are schematic views of practical variations of the present invention.
Figure 9:
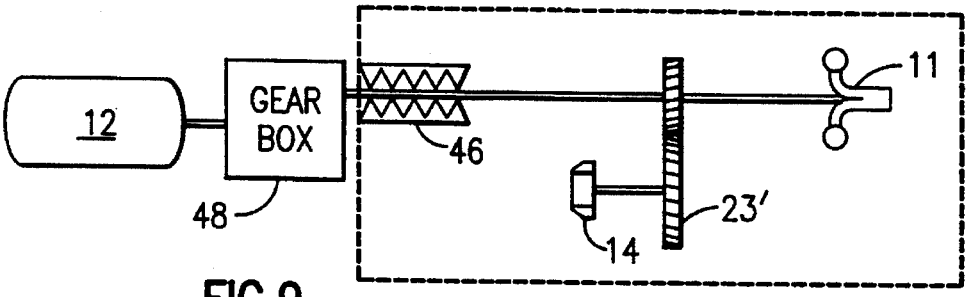
Figure 10:
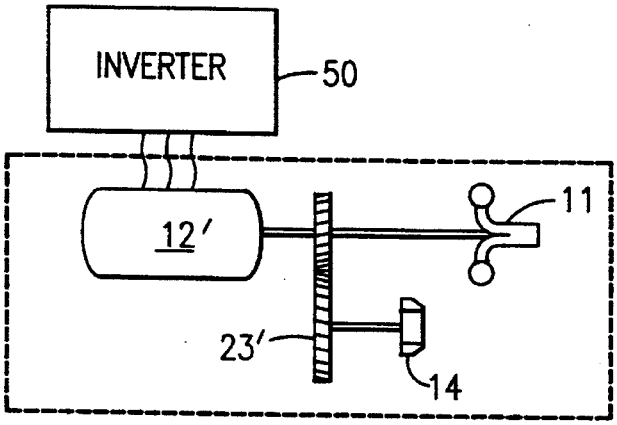

Several variations of the refrigeration system of this invention are shown in FIGS. 8–10. The arrangement described previously with reference to FIG. 3 for example, is an open drive arrangement where the motor 12 is not in a refrigerant atmosphere. Separate seals are required between the turbine 14 and the motor shaft 24 and between the motor shaft 24 and the compressor 11. However, in the arrangement shown in FIG. 8, the turbine expander 14 is mounted on the motor shaft ahead of the gear box 23 for the centrifugal compressor 11. The turbine expander 14 and the compressor 11 are both mounted within a common compressor housing 47, and only a single seal 46 is required, here mounted on the motor shaft 24 at the point of entry into the compressor housing 47. The turbine expander 14 is supported between bearings on the low speed motor shaft or the low speed gear shaft. This arrangement reduces the number of seals required by the system. Also, mounting the turbine between bearings provides improved support to the turbine, with low vibration.

Moreover, with the open drive compressor arrangement described previously in respect to FIG. 3, the gear box 23 is disposed internally within the compressor housing, and thus is much more difficult to service. Higher windage losses occur with a hermetic gear box. In the arrangement shown in FIG. 9, a step-up gear box 48 is situated on the motor shaft, and has an output shaft that is directly coupled to the rotor of the centrifugal compressor 11. A step-down gear box 23' couples to the high speed shaft and couples to the turbine expander 14 which matches the reduced speed, typically 3600 RPM. As the turbine 14 operates at low power relative to the compressor 14, the gear box 23 can be much lighter and less expensive than that required in the FIG. 3 embodiment described earlier. Also, as with the FIG. 8 embodiment, with both the turbine expander 14 and the compressor 11 situated within the common housing 47, only a single seal 46 is required.

FIG. 10 illustrates a hermetic arrangement according to this invention, in which a high speed motor 12' is hermetically sealed inside a common housing with the gear reducer 23,' the turbine expander 14 and the compressor 11. A high-frequency inverter 50 provides high-frequency ac power to the motor 12' for direct drive of the high speed compressor 11. The system is completely sealed within the housing 47 and employs a minimum number of mechanical parts.

While this invention has been described in detail with reference to certain preferred embodiments, it should be understood that the invention is not limited to those embodiments. Rather, many modifications and variations will present themselves to persons skilled in the art without departing from the scope and spirit of this invention as defined in the appended claims.

What is claimed is:

1. Single fluid compression/expansion refrigeration apparatus which comprises a fill of a fluid refrigerant that exists in the apparatus as liquid and as vapor; a rotary compressor having an input shaft that is driven at a predetermined rotary speed, for compressing the vapor thereby adding compression energy to the refrigerant fluid; having an inlet to receive said fluid at a predetermined reduced pressure and an outlet from which the fluid is delivered at an elevated pressure; a drive motor having a drive shaft coupled to said input shaft to rotate the same; condenser means that exhausts heat from the condensed refrigerant to convert the compressed vapor to liquid; a turbine expander having an inlet supplied by said condenser means with said fluid at said elevated pressure as a combination of liquid and vapor for expanding the refrigerant fluid to said reduced pressure, including an output shaft coupled to said rotary compressor input shaft by a speed changing transmission, for recovering at least a part of the compression energy of the refrigerant fluid as it is being expanded and an outlet providing said refrigerant fluid at said reduced pressure; and evaporator means situated in circuit between the outlet of said turbine expander and the inlet of said compressor and fed with said refrigerant fluid at said reduced pressure for evaporating the refrigerant liquid to vapor and absorbing heat, and returning the resulting vapor to said compressor inlet, said turbine expander being sized such that, at the relative speeds of the compressor and turbine expander, the capacity of the turbine expander is matched with the mass flow of liquid and vapor being delivered to said turbine expander inlet.

2. The single fluid refrigeration apparatus of claim 1 wherein said refrigerant is a high pressure refrigerant.

3. The single fluid refrigeration apparatus of claim 2 wherein said refrigerant is selected from the group that consists of R22and R134A.

4. The single fluid refrigeration apparatus of claim 1 wherein said turbine expander is an axial impulse type two-phase flow turbine expander having a rotor with a plurality of peripheral vanes and at least one nozzle directing a jet of said fluid at said vanes.

5. The single fluid refrigeration apparatus of claim 1 wherein said nozzle includes an orifice plate at an inlet thereof.

6. The single fluid refrigeration apparatus of claim 1, wherein said compressor, said evaporator means and said condenser means have a cooling capacity in the range of 100 tons to 1000 tons.

7. The single fluid refrigeration apparatus of claim 6, wherein said compressor includes a centrifugal compressor, said input shaft has a shaft speed of around 15,000 rpm, and said turbine expander rotates at a rotation speed of 3000 to 3600 rpm.

8. The single fluid refrigeration apparatus of claim 7 wherein said turbine expander has a turbine disc with a diameter on the order of about 18.5 cm, and at least one nozzle directing said refrigeration fluid at a peripheral vanes on said disk.

9. The single fluid refrigeration apparatus of claim 1, wherein said compressor is a screw compressor wherein said drive motor is a multipole induction motor and said turbine expander is coupled via a gear box to said motor drive shaft.

10. The single fluid refrigeration apparatus of claim 9, wherein said turbine expander output shaft has a speed of about 3 to 5 times the shaft speed of said drive motor.

11. The single fluid refrigeration apparatus of claim 1 wherein the speed of the turbine expander is such that the tip speed thereof is about one-half the velocity of the liquid and vapor mixture at the inlet.

12. Single fluid compression/expansion refrigeration apparatus which comprises a fill of a fluid refrigerant that exists in the apparatus as liquid and as vapor; a rotary compressor having an input shaft that is driven at a predetermined rotary speed, an inlet, and an outlet, for compressing the vapor and having a predetermined power demand for a given design refrigerant flow; said inlet receiving said fluid at predetermined reduced pressure and said outlet delivering said fluid at an elevated pressure; a drive motor having a drive shaft coupled to said input shaft of said compressor to rotate same; condenser means that exhausts heat from the condensed refrigerant to convert the compressed vapor to liquid; a turbine expander having an inlet supplied by said condenser means with said fluid at said elevated pressure as a combination of liquid and vapor for expanding the refrigerant fluid to said reduced pressure, and including an output shaft coupled to said rotary compressor input shaft by a speed changing transmission for recovering compression energy of said refrigerant fluid as it is being expanded, and an outlet providing said refrigerant fluid at said reduced pressure, said turbine expander being sized such that, at the relative speeds of the compressor and turbine expander, the capacity of the turbine expander is matched with the mass flow of liquid and vapor being delivered to said turbine expander inlet; and evaporator means situated in circuit between the outlet of said turbine expander and the inlet of said compressor and fed with the refrigerant fluid at said reduced pressure for evaporating the refrigerant liquid to vapor and absorbing heat, and returning the resulting vapor to said compressor inlet; the improvement wherein, in a steady state operation, said turbine expander provides about 10% of the power demand of said compressor.

* * * * *